United States Patent [19]

Santisi

[11] 4,221,558

[45] Sep. 9, 1980

[54] BURNER FOR USE WITH OIL OR GAS

[75] Inventor: Harry C. Santisi, Dresher, Pa.

[73] Assignee: Selas Corporation of America, Dresher, Pa.

[21] Appl. No.: 880,016

[22] Filed: Feb. 21, 1978

[51] Int. Cl.[2] ..... F23M 9/00

[52] U.S. Cl. ..... 431/183; 239/138; 239/401; 239/406; 431/186

[58] Field of Search ..... 431/348, 349, 384, 184, 431/43, 183; 239/400, 404, 406, 138, 161, 162, 405

[56] References Cited

U.S. PATENT DOCUMENTS

| | | | |
|---|---|---|---|
| 3,000,435 | 9/1961 | Bloom et al. | 431/348 |
| 3,254,846 | 6/1966 | Schreter et al. | 239/400 |
| 3,236,279 | 2/1966 | Beyer | 431/284 |
| 3,425,634 | 2/1969 | Mutchler | 239/405 |
| 3,498,059 | 3/1970 | Gradon et al. | 239/400 |
| 3,542,500 | 11/1970 | Norcross | 431/183 |
| 3,586,242 | 6/1971 | Lester | 431/183 |
| 3,684,186 | 8/1972 | Helmrich | 239/400 |
| 3,768,250 | 10/1973 | Kawaguchi | 239/406 |
| 3,831,854 | 8/1974 | Sato et al. | 239/406 |
| 4,003,692 | 1/1977 | Moore | 431/284 |

*Primary Examiner*—Samuel Scott
*Assistant Examiner*—Wesley S. Ratliff, Jr.
*Attorney, Agent, or Firm*—Miller & Prestia

[57] ABSTRACT

A burner adapted for use with alternative fluid fuels is provided. The burner includes a cartridge that comprises a nozzle with passage means therein. The nozzle passage means include an entrance adapted to receive a liquid fuel and a plurality of exit ports to discharge the liquid fuel in the direction of the combustion zone. An annular channel is formed around the nozzle and is adapted to supply a gaseous fuel or an atomizing agent for the liquid fuel to slot means, which tangentially communicate with each exit port so that the respective fluids passing through the exit ports and slot means intimately mix and are directed to the combustion zone. Fin means associated with the cartridge impart a swirling pattern to combustion air admitted into the furnace cavity.

18 Claims, 3 Drawing Figures

BURNER FOR USE WITH OIL OR GAS

BACKGROUND OF THE INVENTION

1. Field of the Invention

This invention relates to a demountable fuel feed cartridge adapted to supply alternative fuels to a furnace burner assembly, and to the combination of the cartridge and the burner.

2. Prior Art

Combustion technology presently must face the problem of coping with the forecasted shortage of all types of fuels. One fuel type may be relatively unavailable in a given geographical region, or the cost of that fuel may prohibit its use. Thus, the user must be prepared to convert from a costly or unavailable fuel to another more inexpensive or readily available fuel source. Changeover time and cost should be held to a minimum so that the user will be able to convert without unduly interrupting his production schedule.

Further, a device that facilitates a quick conversion from one fuel to another should be adapted for installation in existing furnaces.

At the same time, liquid and gaseous fuel burners alike must be provided with means to intimately admix the fuel with the requisite amount of combustion air to provide for an even, widespread that flows along the cup surface evenly.

Further, liquid fuel burners should be provided with means for atomizing or vaporizing the fuel reasonably completely.

The multi fuel burners disclosed by Bloom et al U.S. Pat. No. 3,000,435; Beyer U.S. Pat. No. 3,236,279; and Norcross U.S. Pat. No. 3,542,500, disclose burners capable of alternative fuel use. However, these disclosed devices cannot readily be installed in existing furnaces.

Mutchler U.S. Pat. No. 3,425,634, although disclosing a nozzle that is compatible with different fuels, does not disclose or suggest the use of a cartridge that allows any easy conversion from one fuel type to another.

OBJECTS OF THE INVENTION

It is accordingly an object of the present invention to provide an alternative fuel feed cartridge that is easily installed in existing furnace cavities.

It is a more specific object to provide an easily installable cartridge that is capable of providing for quick conversion from one fuel type to another.

It is a further object to provide a cartridge wherein the nozzle provides an intimate admixture of the requisite combustion air and fuel so that an even widespread flame is formed in the combustion zone.

It is an even more specific object to provide a cartridge that, when liquid fuel is used, completely atomizes the liquid and then intimately admixes the atomized liquid with the requisite combustion air.

Other objects and advantages of this invention, including the simplicity and economy of the same will readily become apparent hereinafter and in the drawings.

DESCRIPTION OF THE PREFERRED EMBODIMENT

Figure 1:
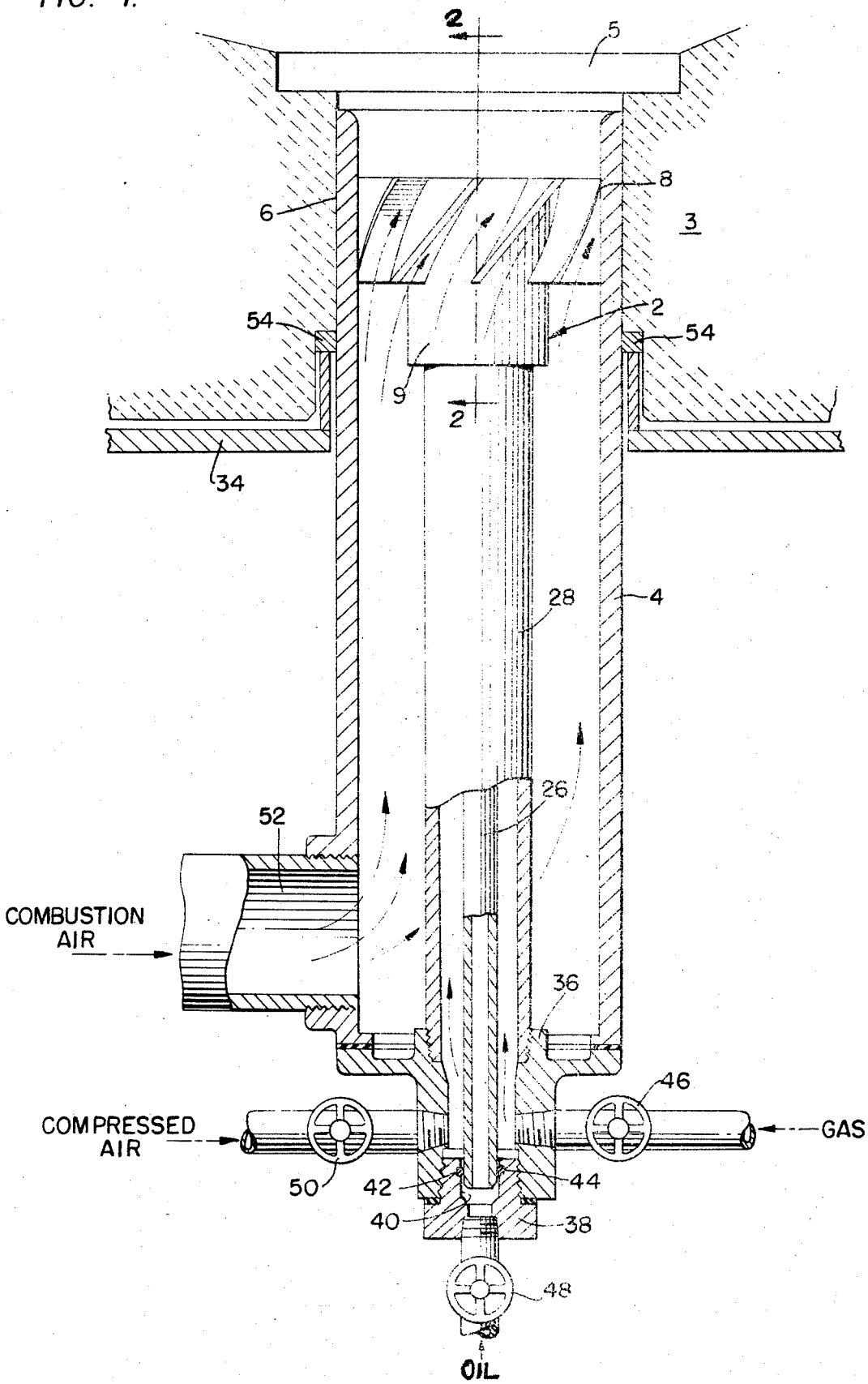
FIG. 1 is a longitudinal cross section of a burner in accordance with the invention.

The following description is not intended to limit the scope of the invention, as defined in the appended claims, but will be presented in specific terms in order to describe the construction and operation of the particular form of the invention that has been selected for illustration in the drawings.

Figure 2:
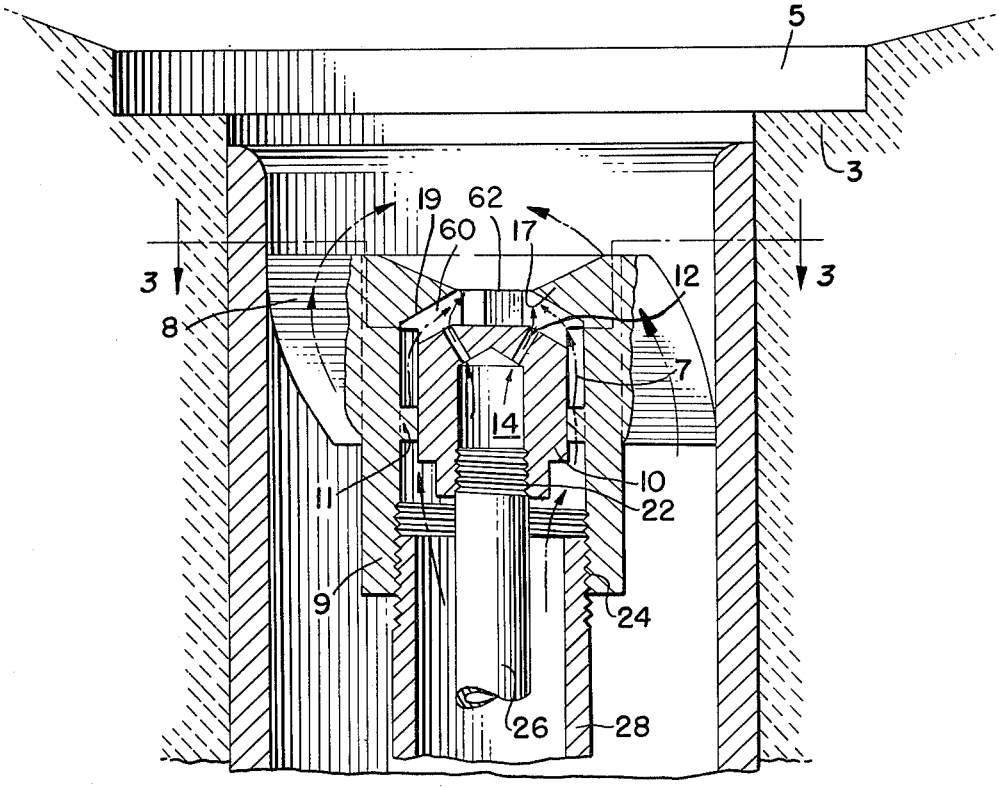
FIG. 2 is a fragmentary sectional view of the nozzle tip portion of the cartridge disposed within a furnace cavity in accordance with the invention taken as indicated by the lines and arrows 2—2 which appear in FIG. 1.

With reference to FIGS. 1 and 2, there is shown a burner block 3 having a generally cup shaped combustion zone 5. Cartridge 2 is mounted within cylindrical housing 4, and housing 4 lines furnace wall cavity 6. Fins 8 of collar 9 extend radially from the exterior collar wall to form a snug fit with housing 4. The cartridge 2 can be mounted within any type of furnace cavity; preferably fins 8 and housing 4 fit securely therebetween. Further, the metallic collar 9 is generally disposed coaxially with respect to the sleeve and/or cavity longitudinal axis.

Nozzle 10 of generally cylindrical shape is mounted within collar 9 by a plurality of spacer ribs 11. Ribs 11 provide substantially even spacing between the collar-block interface to provide a generally annular passage 7 therebetween.

Nozzle 10 is desirably composed of a high temperature resistant metal or metallic alloy and is provided with exit ports 12 and communicating entrance 14. The entrance 14 is adapted to receive liquid fuel line 26 and the exit ports 12 are adapted to discharge the liquid fuel toward the cup 5.

Slots 60 are also provided in the nozzle 10 to tangentially communicate with each of the exit ports 12. Collar 9 includes annular shoulder 17 that surrounds and overlies the slots 60, which deliver atomized oil or gaseous fuel to the combustion air which has passed over fins 8. The nozzle and shoulder mate as shown at 19.

In a preferred embodiment, the slots 60 intersect the exit ports 12 approximately at right angles and the respective fluids passing through the slots 60 and ports 12 intimately mix and are directed toward the cup 5 through the opening 62 provided in the shoulder 17.

Threaded fitting 22 is provided on the nozzle 10 to faciliate coupling of a liquid fuel line 26 to entrance 14. Likewise, fitting 24 on the interior collar wall provides connection for a pressurized gas line 28 that may carry any type of combustible gas or compressed air or steam for atomization.

Figure 3:
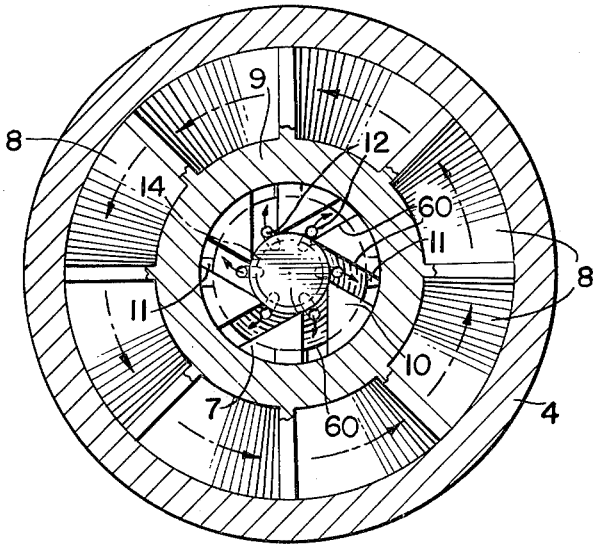
FIG. 3 is a fragmentary sectional view taken as indicated by the lines and arrows 3—3 which appear in FIG. 2.

A plurality of separate exit ports 12 may be provided as seen in FIG. 3, the ports terminate along equal intervals about annular passage 7. I have found that the provision of six exit ports results in an optimal admixture of the fuel, atomizing agent and combustion air.

As shown in FIG. 1, the assembly is positioned in cavity 6 of the burner block 3. The block 3 is provided with lining 34. Gasket 54 surrounds the housing 4 and seals the cavity 6.

The pressurized gas line 28 is securely anchored in annular boss 36 formed in the rearward end of housing 4, and the liquid fuel line 26 extends rearwardly of boss 36 and is seated within the bore 40 formed within plug 38 that seals the rearward end of the housing. O-ring gaskets 42 and 44 are provided to seal the liquid fuel line 26.

Valve 46, connected to a source of gaseous fuel, such as natural gas or propane, regulates the admittance of the gaseous fuel to gas line 28. Likewise, valve 48, connected to a liquid fuel source, such as oil, regulates the admittance thereof into liquid fuel line 26.

Valve 50 is operatively connected to a source of compressed air so as to regulate admittance of same to pressurized gas line 28.

Inlet 52 allows entry of combustion air into housing 4, and the combustion air is pushed through the fins 8 and swirled as it enters the combustion zone 5 where it mixes with the desired liquid or gaseous fuel to produce a combustible mixture.

In operation as an oil fuel burner, valve 48 is opened, and the oil pressure is preferably regulated to about 30 p.s.i. The gas valve 46 is closed, and compressed air valve 50 opened, so as to provide air to atomize the oil. A suitable pressure for the atomizing air is about one and one-half p.s.i. The requisite amount of combustion air is admitted to the housing 4 and passes through the fins 8 and is swirled toward the combustion zone 5.

Accordingly, the oil fuel and atomizing air mix in the slots 60 and the mixture is delivered into the swirling combustion air that has passed through fins 8.

If a gaseous fuel is to be used, the liquid fuel valve 48 is closed and gas valve 46 opened. Compressed air valve 50 is closed. Thus, the gaseous fuel passes through annular passage 7 and communicating slots 60. The exiting gaseous fuel admixes with the requisite amount of swirling combustion air at the combustion zone 5. As in the case of oil, the combustion air flows in the annular space inside the housing 4 and through the fins 8.

Although this invention has been described with reference to one specific form thereof, selected for illustration in the drawings, it will be appreciated that many aspects of the disclosure may be varied, without departing from the spirit and scope of the invention. For example, the manner of fitting the cartridge into its cavity in the burner block may be varied, as by using a suitable cement or the like. Further, a variety of changes may be made in the form, shape and material of the housing lining the cavity in the burner block, and in some instances it may even be possible to dispense with such housing. Further, a variety of changes may be made with respect to the manner in which the various fluids are connected, and how they are delivered to the burner. Other changes, substitutions and reversals of parts will become apparent to one skilled in the art.

Those skilled in the art will be able to devise members equivalent to those shown for connecting the various fuel and atomizing agent sources. The following claims are intended to cover all such equivalent members.

I claim:

1. A burner assembly mounted within a generally cylindrical furnace cavity, comprising in combination, (A) a burner having a generally cup shaped combustion zone;

(B) a dual fuel feed cartridge adapted to discharge alternative fluid fuels in the direction of said combustion zone, said cartridge having;

(a) a nozzle mounted in said cavity;

(b) passage means in said nozzle having an entrance adapted to receive a liquid fuel and a plurality of exit ports to discharge said fuel toward said cup;

(c) slot means tangentially communicating with each said exit port and defining a plurality of slots to direct fluids into said cup, said slot means located in said nozzle;

(d) fin means surrounding said slot means (c) to swirl combustion air admitted into said cavity, as it is supplied to said cup;

(e) means for conducting a liquid fuel to said passage means (b);

(f) means for conducting a gaseous fuel or atomizing agent to said slot means (c);

(g) means for selectively activating and deactivating said means (e) and (f) to conduct alternative fuels to said cup if desired.

2. A dual fuel feed cartridge as recited in claim 1, wherein said means (f) comprise an annular chamber around said nozzle.

3. A dual fuel feed cartridge as recited in claim 1 further including an annular shoulder interposed between said nozzle and said cup and overlying said slot means (c).

4. A dual fuel feed cartridge as recited in claim 1, wherein said slot means (c) intersect said exit ports at about a normal angle.

5. A dual fuel feed cartridge as recited in claim 1, wherein said passage means (b) comprises six exit ports.

6. A dual fuel feed cartridge as recited in claim 1, further including a cylindrical housing lining said cavity.

7. A dual fuel feed cartridge adapted to supply alternative fuels to a radiant cup burner assembly of the type mounted within a generally cylindrical furnace cavity, said cartridge comprising:

(a) a collar mounted within said cavity;

(b) fin means extending from and surrounding said collar to impart a swirling pattern to combustion air admitted into said cavity as it is supplied to said cup;

(c) a nozzle mounted within said collar;

(d) nozzle passage means including an entrance adapted to receive a liquid fuel and a plurality of exit ports to direct said liquid fuel toward said cup;

(e) slot means tangentially communicating with each said exit port and defining a plurality of slots to direct fluids into said cup;

(f) means forming a generally annular passage between said collar and said nozzle, said annular passage to supply a gaseous fuel or atomizing agent to said slot means (e);

(g) means for conducting a liquid fuel to said nozzle passage means (d); and (h) means for conducting a gaseous fuel or atomizing agent to said annular passage; and (i) means for selectively activating and deactivating said means (g) and (h) in a manner to provide said alternative sources of fuel to said cartridge.

8. A dual fuel feed cartridge as recited in claim 7, wherein said slot means (e) is located in said nozzle.

9. A dual fuel feed cartridge as recited in claim 8 wherein said nozzle comprises an outer end and an inner end facing said cup, and wherein said collar includes an outer end and an inner end facing said cup, and wherein said inner end of said nozzle is indented behind said inner collar end.

10. A dual fuel feed cartridge as recited in claim 9 wherein said inner collar end is provided with an annular shoulder coaxial with said nozzle and overlying said slot means (e).

11. A dual fuel feed cartridge as recited in claim 10 wherein said slot means (e) perpendicularly intersects each said exit port.

12. A dual fuel feed cartridge as recited in claim 7 wherein six exit ports are provided.

13. A dual fuel feed cartridge as recited in claim 7 further comprising a cylindrical housing, said housing lining said cavity and wherein said fin means are coaxially mounted within said housing.

14. A dual fuel feed cartridge as recited in claim 7 wherein pressurized air is conducted through said means (h) so that said liquid fuel is atomized.

15. A dual fuel feed cartridge as recited in claim 7 wherein natural gas is conducted through said means (h) and said means (g) is deactivated.

16. A dual fuel feed cartridge as recited in claim 7 wherein propane gas is conducted through means (h) and said means (g) is deactivated.

17. A dual fuel feed cartridge as recited in claim 7 wherein oil is conducted through said means (g) and pressurized air is conducted through said means (h).

18. A dual fuel feed cartridge as recited in claim 1 or 7, wherein said plurality of slots are defined in a helical pattern.

* * * * *

UNITED STATES PATENT AND TRADEMARK OFFICE

CERTIFICATE OF CORRECTION

PATENT NO. : 4,221,558

DATED : September 9, 1980

INVENTOR(S) : Harry C. Santisi

It is certified that error appears in the above-identified patent and that said Letters Patent are hereby corrected as shown below:

Column 1, line 28, "widespread" should be followed by --flame--.

Column 1, line 41, "any" should read --an--.

Signed and Sealed this

*Twenty-fifth* Day of *November 1980*

[SEAL]

*Attest:*

SIDNEY A. DIAMOND

*Attesting Officer*

*Commissioner of Patents and Trademarks*